United States Patent [19]

Kostylev et al.

[11] Patent Number: 4,705,119

[45] Date of Patent: Nov. 10, 1987

[54] ANNULAR AIR-HAMMER APPARATUS FOR DRILLING HOLES

[75] Inventors: Alexandr D. Kostylev; Boris B. Danilov; Boris N. Smolyanitsky; Vladimir P. Boginsky, all of Novosibirsk; David I. Kogan, Moscow; Oleg V. Smirnov, Moscow; Vyacheslav N. Saveliev, Moscow, all of U.S.S.R.

[73] Assignee: Institut Gornogo Dela So An SSSR, Novosibirsk, U.S.S.R.

[21] Appl. No.: 901,943

[22] Filed: Aug. 29, 1986

[30] Foreign Application Priority Data

Sep. 16, 1985 [SU] U.S.S.R. ..... 3955103

[51] Int. Cl.[4] ..... E21C 3/24; E21B 4/14

[52] U.S. Cl. ..... 175/92; 173/73; 175/215; 175/296

[58] Field of Search ..... 173/17, 73, 75, 76, 173/77, 78, 79, 80, 138, 59; 175/92, 100, 215, 296, 405

[56] References Cited

U.S. PATENT DOCUMENTS

| | | | |
|---|---|---|---|
| 3,299,971 | 1/1967 | Lewis | 175/92 |
| 3,524,511 | 8/1970 | Klemm | 173/78 |
| 3,795,283 | 3/1974 | Oughton | 175/215 |
| 4,321,974 | 3/1982 | Klemm | 175/92 |

FOREIGN PATENT DOCUMENTS

| | | | |
|---|---|---|---|
| 2854461 | 6/1980 | Fed. Rep. of Germany | 175/92 |

*Primary Examiner*—Donald R. Schran
*Assistant Examiner*—Hien H. Phan
*Attorney, Agent, or Firm*—Fleit, Jacobson, Cohn & Price

[57] ABSTRACT

An annular air-hammer apparatus for drilling holes incorporates a hollow cylindrical case with a stepped bore which has inlet and outlet ports. A rock-cutting tool with an axial opening is fitted to the case at the forward end thereof. A chips-receiving sleeve and a stepped ring-shaped hammer are located inside the case, whereby the hammer forms a working-stroke chamber with the case and an idle-stroke chamber with the case, the rock-cutting tool and the chips-receiving sleeve. The chips-receiving sleeve has a cylindrical protuberance at its upper end which interacts with the hammer when this is in its topmost position. A channel is provided in the idle-stroke chamber at that side thereof which faces the upper end face of the hammer.

2 Claims, 3 Drawing Figures

ANNULAR AIR-HAMMER APPARATUS FOR DRILLING HOLES

INDUSTRIAL APPLICATION

The invention relates to air-hammer apparatus employed for drilling holes in mining, construction and prospecting which use a concentric string and transport the rock broken up at the bottom of the hole through the central pipe in the form of cores and chips to the surface by means of the return flow of the agent providing motive power. More specifically, the invention is concerned with annular air-hammer apparatus fur drilling holes.

The invention may be of utility in drilling holes for various applications such as searching for mineral deposits in permafrost regions and on the Continental Shelf, blasting rock in open pits and sinking pile foundations at construction sites.

Background of the Invention

Specific conditions of air-hammer drilling render the dust-collecting equipment commonly provided at the wellhead ineffective as a means of maintaining the dust content of the atmosphere at the working place within the limits specified by hygienics. For deducting, an aerated solution can be fed into the hole. However, as far as the drilling in permafrost is concerned, this method is inapplicable: the wall of hole may thaw and cave or, in the case of prospecting, a mineral sought may displace from a higher level of a hole to a lower one so that the factual geological data may become misleading. Therefore, air-hammer drilling finds limited application in permafrost regions.

A radical solution to the problem of thawing and caving of holes, dedusting the drillman's working place and acquiring trust-worthy geological information can be obtained by employing annular air-hammer drilling apparatus which dispose of the chips via the central pipe of concentric string with a constant cross-sectional area connected to a dust-collecting equipment, e.g. a cyclone, at the surface. Since the agent providing motive power is isolated from direct contact with the wall of hole and the velocity of the chips-laden return flow of the agent through the central pipe is constant, the difficulties referred to above are inexistent in this case.

There is known an annular air-hammer drilling apparatus (cf. Patentschrift No. 2854461 Bundesrepublic Deutchland, IPC E21C 3/24, 1978) termed perforator which incorporates a rock-cutting tool and an annular hammer reciprocating in a cylindrical case with air-distributing ports and striking against the tool. The perforator is provided with a non-return valve and an internal chips receiver, and is employed with a concentric string.

The known perforator and similar apparatus for core drilling rely on a combined effect of an impact against, and a rotary motion of, the tool. They are provided in the form of air-operated down-the-hole units in which air reaches the hammer via the annular gap in the concentric string and the non-return valve. Spent air leaves into the bottom-hole region.

The known annular air-hammer drilling apparatus has an intricate system of distributing air, and many parts thereof are made of light-gauge shapes. Therefore, it lacks operational reliability and fails to find a widespread industrial application so far.

Also known is an annular air-hammer drilling apparatus (cf. USSR Inventor's Certificate No. 1133388, IPC E21C 3/24, 1985) a hollow cylindrical case whereof is fitted at the front end with a rock-cutting tool having blow off ports and contains a chips receiver and a stepped annular hammer capable of reciprocating back and forth. The hammer is fitted concentrically with the case and interacts with the outside surface of a stepped sleeve which has inlet and outlet ports and is fixed in the case bore. In reciprocating, the hammer forms an idle-stroke chamber with the case and a working-stroke chamber with the stepped sleeve. Another sleeve interposed between a step of the stepped sleeve of a larger diameter and the hammer with provision for axial displacement has an annular recess at its midlength fitting whereinto is a projecting stop of the hammer.

The above features of design permit control of the time interval during which air is being admitted into the working-stroke chamber and, consequently, increase the impact force of the apparatus. But in the known apparatus the outflow of spent air from the working-stroke chamber is passed into the chips receiver through the ports of the stepped sleeve which are located at some distance from the bottom hole. Only a small fraction of the air (about 20%) escapes into the bottom hole space via the blow off ports of the rock-cutting tool, bypassing the hammer. Therefore, the rate of advance of the material forced up the chips receiver in the form of disintegrated core and chips, as broken off at the bottom hole, is slow until the outlet ports are reached where a combined current of air accelerates the material to the specified velocity of lifting up the chips receiver. Such a pattern of air flow may bring about plugging up of the rock-cutting tool and the chips receiver at its lower end by the material. Not excluded is also an ingress of particulate material into the working-stroke chamber through the ports of the air-distributing sleeve which may lead to an abrasive wear of the rubbing surfaces or even to the sizing of the hammer in the case.

A plugging up of the core receiver may cause the backpressure in the outlet line of the known annular air-hammer apparatus to rise greatly, destabilizing the operation of the hammer throughout a cycle. Its frequency and impact force may deviate from the design values.

All in all, these factors have an adverse effect on the reliability and efficiency of the known annular air-hammer apparatus.

SUMMARY OF THE INVENTION

It is an object of the invention to improve the performance (i.e. increase the frequency and impact force of strokes) of the apparatus.

Another object of the invention is to increase the operational reliability of the apparatus.

These and other objects are realized by providing an annular air-hammer apparatus for drilling holes comprising a hollow cylindrical case with a stepped bore; inlet ports in a step of the bore of a smaller diameter and outlet ports in a step of the bore of a larger diameter; a rock-cutting tool attached to the forward end of the case and provided with an axial opening; a chips-receiving sleeve and a stepped ring-shaped hammer which are both located in the bore of the case; whereby the hammer is fitted concentrically with the case with provision for reciprocating back and forth so as to form a working-stroke chamber with the case and an idle-stroke chamber with the case, the rock-cutting tool and the chips-receiving sleeve; the two chambers alternately communicating via the inlet ports with a line for feeding a compressed gaseous fluid and via the outlet ports with the bottom hole; wherein according to the invention the chips-receiving sleeve has a cylindrical protuberance at its upper end which interacts with the hammer, when this comes into its topmost position, and separates the idle-stroke chamber into an upper space and a lower space at the same time, whereby a channeling means serving to connect the working-stroke chamber to the upper space of the idle-stroke chamber at regular intervals is provided in the idle-stroke chamber at that side thereof which faces the upper end face of the hammer.

It will be noted that in the disclosed apparatus the hammer is accelerated during the idle stroke, for the idle-stroke chamber is separated into an upper and a lower space and compressed air is expelled from that space where its presence would slow down the progress of the hammer.

The acceleration of the hammer on the working stroke is higher than in the known apparatus. The hammer is acted upon by a resultant force due to the pressure of compressed air in the working-stroke chamber, which is connected to the compressed air line at regular intervals, and the pressure in the upper space of the idle-stroke chamber which is formed by the cylindrical protuberance of the chips-receiving sleeve and communicates with the working-stroke chamber. The two forces acting on the hammer coincide in direction and its speed on the working stroke therefore increases.

Summing up, two accelerations of the hammer occur in the disclosed apparatus, on the idle stroke and on the working one. Therefore, the frequency and impact force of the strokes increases there.

It is expedient that the channeling means is provided in the form of at least a single longitudinal groove which extends between the inlet ports of the case through a full-length stroke of the hammer.

This plan permits an optimum performance of the ring-shaped hammer to be achieved in spite of a limited radial extent of its working surface. An optimum relationship between the cross-sectional area of the channeling means and the volume of the chambers which is established in this case provides for a minimum consumption of compressed air, ensuring economical operation of the hammer unit and the apparatus as a whole.

BRIEF DESCRIPTION OF THE DRAWINGS

A preferred embodiment of the invention will now be described with reference to the accompanying drawings in which.

DETAILED DESCRIPTION OF THE INVENTION

Figure 1:
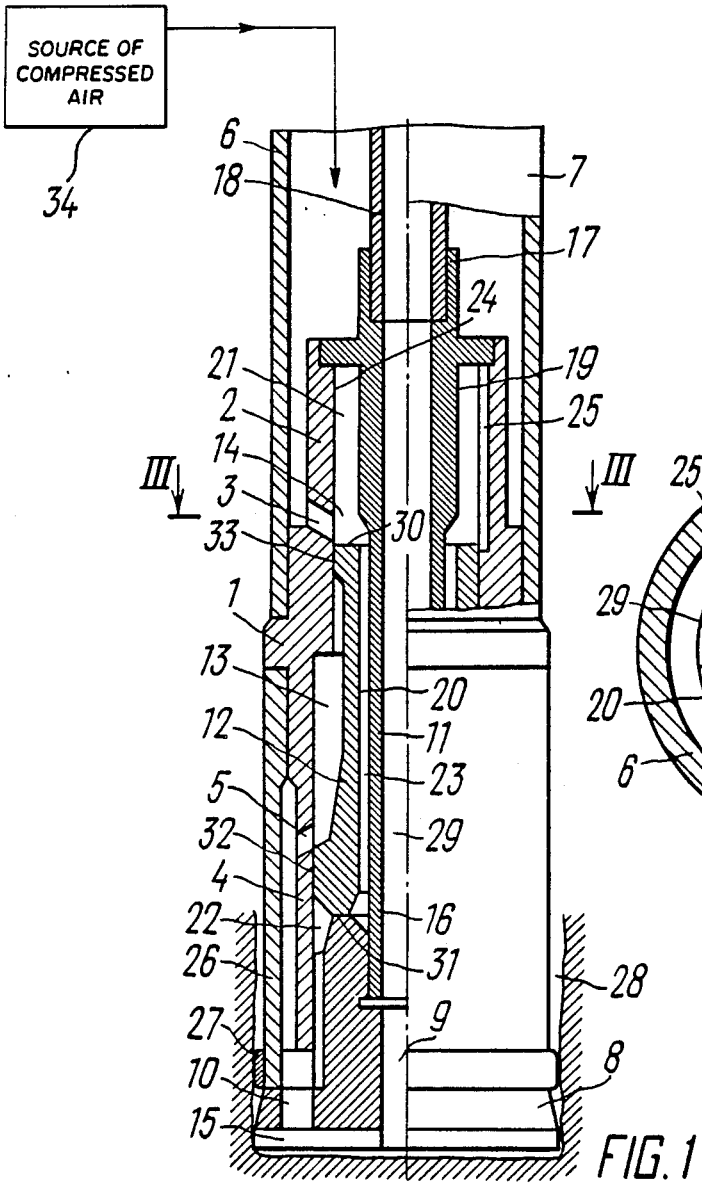
FIG. 1 is a schematic cross-sectional elevation of the annular air-hammer apparatus for drilling holes according to the invention, in a position when the hammer strikes against the rock-cutting tool.
Figure 2:
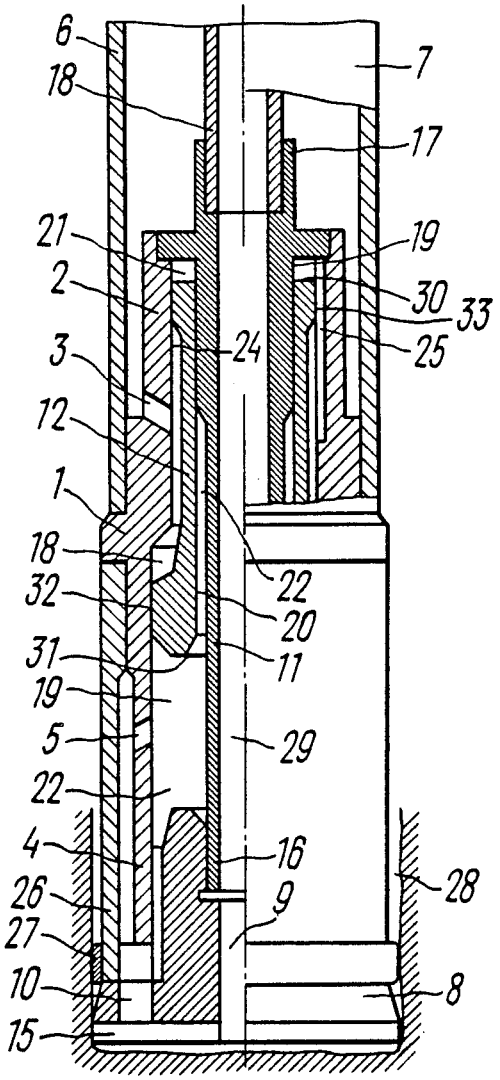
FIG. 2 is a schematic cross-sectional elevation of the annular air-hammer apparatus for drilling holes according to the invention, in a position when the hammer is on the idle stroke and arrives at its topmost station.

Referring to FIGS. 1 and 2, the annular air-hammer apparatus for drilling holes incorporates a hollow cylindrical case 1 with a stepped bore. A step 2 of a smaller diameter located at the top of the case 1 is provided with inlet ports 3 admitted wherethrough from a line is a compressed gaseous fluid, and a step 4 of a larger diameter which faces the bottom hole is provided with outlet ports 5. The case 1 is rigidly attached at its top to an external pipe 6 of a concentric string 7. A rock-cutting tool 8 with an axial chips-receiving opening 9 and blow off passages 10 is fitted to the step 4 at the lower end of the case 1 with provision for axial displacement. Contained in the bore of the stepped case 1 there are a static chips-receiving sleeve 11 and a stepped ring-shaped hammer 12 capable of reciprocating back and forth concentrically with the case 1 so as to form a working-stroke chamber 13 with the case 1 and an idle-stroke chamber 14 with the case 1, the rock-cutting tool 8 and the chips-receiving sleeve 11. The chambers 13 and 14 alternately communicate with the bottom hole 15 via the outlet ports 5.

Figure 3:
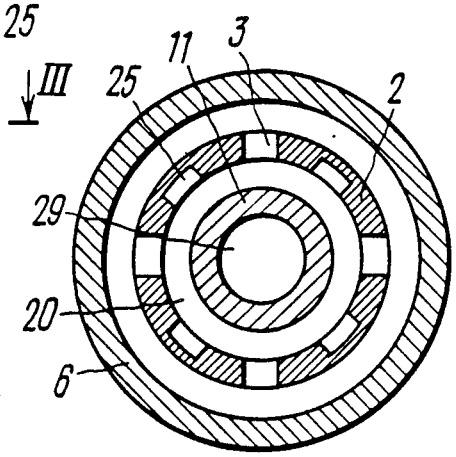
FIG. 3 is a section on line III—III of FIG. 1.

The lower end 16 of the chips-receiving sleeve 11 fits into the axial chips-receiving opening 9 of the rock-cutting tool 8, and the upper end 17 of the chips-receiving sleeve 11 is linked to the internal pipe 18 of the concentric string 7. A cylindrical protuberance 19 of the chips-receiving sleeve 11 provided at the upper end thereof interacts with the bore 20 of the hammer 12 when this arrives into its topmost position (FIG. 2) so as to separate the idle-stroke chamber 14 into an upper space 21 and a lower space 22 which communicates with each other through an annular passage 23. The idle-stroke chamber 14 is provided wtih a channeling means in the form of a single longitudinal groove 25 located in the cylindrical bore 24 of the step 2 of the case 1 between the inlet ports 3 (FIG. 3). Alternatively, a plurality of such grooves 25 can be provided for.

A shell 26 serves to protect the apparatus, e.g. its working-stroke chamber 13, against an ingress of chips. A packer 27 provided at the bottom of the shell 26 isolates the bottom hole 15 from the shell-borehole annulus 28 in order to induce a flow of spent air from the bottom hole 15 into the bore 29 of the chips-receiving sleeve 11.

The fact that in the embodiment of the invention disclosed hereinabove the cylindrical protuberance 19 of the chips-receiving sleeve 11 at the upper end thereof interacts with the bore 20 of the hammer 12 and separates the upper space 21 of the idle-stroke chamber 14 from the lower space 22 thereof at regular intervals and that the channeling means is provided in the idle-stroke chamber 14 at the side thereof facing the upper end face of the hammer 12 to connect this chamber to the compressed air line through the working-stroke chamber 13 at regular intervals when the hammer 12 arrives into its topmost position ensures an effective utilization of the area of the upper end face 30 of the hammer 12 with the result that the forces acting thereupon during every operating cycle augment and the performance of the apparatus (i.e. the frequency and force of strokes) improves and its reliability increases.

In operation, the compressed air fed from source 34 over the annular space between the internal pipe 18 (FIG. 1) and the external pipe 6 of the string 7 is admitted into the idle-stroke chamber 14 through the inlet ports 3, whereby the working-stroke chamber 13 is connected to the bore 29 of the chips-receiving sleeve 11 via the open outlet ports 5, the blow off passages 10 of the rock-cutting tool 8 and the bottom hole 15. The air admitted into the idle-stroke chamber 14 acts on both the upper and lower end faces 30 and 31, respectively, of the hammer 12. The resulting forces oppose one another in direction. However, the area of the lower end face 31 is larger than that of the upper end face 30, and the hammer 12 starts moving upwards (FIG. 1), beginning an idle stroke. As soon as collars 32 and 33 of the hammer 12 overlap the outlet ports 5 and the inlet ports 3, respectively, the flow of air into the idle-stroke chamber 14 is interrupted. In continuing on the idle stroke, the hammer reaches the cylindrical protuberance 19 of the chipsreceiving sleeve 11 which closes the annular passage 23, separating thus the upper space 21 of the idle-stroke chamber 14 from the lower space 22 thereof. At the same time, the hammer 12 uncovers the longitudinal grooves 25 which connect the upper space 21 of the idle-stroke chamber 14 to the working-stroke chamber 13. The air contained in the upper space 21 of the idle-stroke chamber 14 escapes into the working-stroke chamber 13, and the pressure in the two chambers 13 and 14 is equalized. But since the volume of the working-stroke chamber 13 exceeds that of the idle-stroke chamber 14 three- to sixfold whereas the volume of the upper space 21 of the idle-stroke chamber 14 is between only 1/6 and 1/10 of the volume of the working-stroke chamber 13, the equalized pressure in the two chambers is slightly above the atmospheric pressure and greatly less than the pressure in the compressed air mains. The air pressure applied to the upper end face 30 of the hammer 12 and hampering its progress decreases whereas the pressure which the air in the lower space 22 of the idle-stroke chamber 14 exerts on the lower end face 31 of the hammer 12 remains unchanged. The resulting pressure difference accelerates the hammer 12, enabling it to complete the idle stroke within a shorter time interval.

Further upward progress of the hammer 12 connects the outlet ports 5 to the lower space 22 of the idle-stroke chamber 14 and the inlet ports 3 to the working-stroke chamber 13. The air contained in the lower space 22 of the idle-stroke chamber 14 escapes, and compressed air is admitted into the working-stroke chamber 13 and hence into the upper space 21 of the idle-stroke chamber 14 via the grooves 24.

The air pressure set up in the two chambers and applied to the upper end face 30 of the hammer 12 and the annular area formed due to the difference between the diameters of the large-diameter collar 32 and the small-diameter collar 33 causes the hammer 12 to stop and reverse the direction of its travels, starting a working stroke downwards (FIG. 2). As the collars 32 and 33 of the hammer 12 overlap the inlet ports 3 and the outlet ports 5, the source of the motive power of the hammer 12 is the energy of the air expanding in the working-stroke chamber 13 and the upper space 21 of the idle-stroke chamber 14. Continuing its downward travel, the hammer 12 disconnects the working-stroke chamber 13 from the upper space 21 of the idle-stroke chamber 14 due to its collar 32 which overlaps the longitudinal grooves 24 and connects the upper space 21 to the lower space 22 of the idle-stroke chamber 14 through the uncovered annular passage 23. The pressure in the two spaces 21 and 22 of the idle-stroke chamber 14 equalizes. At the same time, the inlet ports 3 are connected to the idle-stroke chamber 14 and the outlet ports 5 to the working-stroke chamber 13. The air contained in the working-stroke chamber 13 escapes and compressed air enters the idle-stroke chamber 14. The hammer 12 strikes against the rock-cutting tool 8, and the rock broken off is carried to the surface by a current of spent air via the annular chips-receiving opening 9 in the rock-cutting tool 8, the bore 29 of the chips-receiving sleeve 11 and the internal pipe 18 of the concentric string 7.

The regular separations of the idle-stroke chamber 14 into two spaces followed by the connections of its upper space 21 to the working-stroke chamber 13 are the factors which augment the forces applied to the hammer 12 in operation. The area of the hammer acting whereupon is compressed air is expanded both during the working and idle strokes. The speed of the hammer 12 increases, and the periods of effecting the idle and working strokes are shortened.

The disclosed apparatus compares favourably with the known annular air-hammer apparatus for drilling holes, featuring a 1.5-fold increase in the frequency of strokes, high impact strength and operational reliablity.

What is claimed is:

1. An annular air-hammer apparatus for drilling holes comprising:

a hollow cylindrical case with a stepped bore inlet ports provided in a step of a smaller inside diameter of said case outlet ports provided in a step of a larger inside diameter of said case;

a rock-cutting tool which has an axial opening and is attached to the forward end of said case;

a chips-receiving sleeve fixed inside said case concentrically therewith and extending throughout full length thereof;

a stepped ring-shaped hammer which is fitted inside said case concentrically therewith with provision for reciprocating back and forth and has an axial bore passing wherethrough is said chipsreceiving sleeve;

a source of compressed gaseous fluid;

a line for compressed gaseous fluid connected to said source of compressed gaseous fluid;

a working-stroke chamber which is formed in said case by said hammer and is connected to said line for compressed gaseous fluid through said inlet ports in order to provide motive power for said hammer on a working stroke thereof;

an idle-stroke chamber which is formed in said case by said rock-cutting tool and said chips-receiving sleeve and is connected to the bottom of a hole being drilled through said outlet ports in order to provide motive power for said hammer on an idle stroke thereof and admit spent air into the bottom hole for delivering chips upwardly through over said chipsreceiving sleeve;

a cylindrical protuberance of said chips-receiving sleeve at an upper end thereof which interacts with said hammer, when said hammer arrives into its topmost position, and separates said idle-stroke chamber into an upper space and a lower space, reducing thereby the pressure of the compressed gaseous fluid in said idle-stroke chamber;

a channeling means which is located in said idle-stroke chamber and in the step of the smaller inside diameter which faces an upper end face of said hammer and serves to connect said working-stroke chamber to said upper space of said idle-stroke chamber which is connected to said line for compressed gaseous fluid at the instant when said hammer is in its topmost position.

2. An apparatus as claimed in claim 1, wherein said channeling means is provided in the form of at least a single longitudinal groove which extends between said inlet ports through a full-length stroke of said hammer.

* * * * *